United States Patent [19]

Yurko

[11] 3,959,165

[45] May 25, 1976

[54] BIODEGRADABLE, NON-POLLUTING, HEAVY DUTY SYNTHETIC ORGANIC DETERGENT COMPOSITION

[75] Inventor: Joseph A. Yurko, Bayonne, N.J.

[73] Assignee: Colgate-Palmolive Company, New York, N.Y.

[22] Filed: Sept. 15, 1972

[21] Appl. No.: 289,652

[52] U.S. Cl. ..... 252/109; 252/121; 252/135; 252/535; 252/540; 252/554; 252/559; 252/DIG. 6

[51] Int. Cl.[2] ..... C11D 9/10

[58] Field of Search ..... 252/109, 121, 135, 535, 252/540, 554, 559, DIG. 6

[56] References Cited

UNITED STATES PATENTS

| | | | |
|---|---|---|---|
| 2,954,348 | 9/1960 | Schwoeppe | 252/554 X |
| 3,009,882 | 11/1961 | Clarke et al. | 252/535 X |
| 3,144,412 | 8/1964 | Inamorato | 252/559 X |
| 3,242,091 | 3/1966 | Monick | 252/121 X |
| 3,527,707 | 9/1970 | McAteer et al. | 252/554 X |
| 3,629,121 | 12/1971 | Eldib | 252/559 X |
| 3,682,849 | 8/1972 | Smith et al. | 252/135 X |
| 3,714,074 | 1/1973 | Inamorato | 252/121 |
| 3,749,675 | 7/1973 | Chang | 252/135 |

*Primary Examiner*—Stephen J. Lechert, Jr.
*Attorney, Agent, or Firm*—John J. Tomaszewski; Murray M. Grill; Herbert S. Sylvester

[57] ABSTRACT

A biodegradable, non-polluting heavy duty synthetic organic detergent composition which washes laundry well, leaves it feeling softer than laundry washed with other commercially available and successful non-polluting products and is suitable for use at low temperatures without causing yellowing of the white articles of laundry washed includes higher paraffin sulfonate, ethoxylated alcohol nonionic detergent, soap, alkali metal silicate, alkali metal carbonate (which may be accompanied by bicarbonate), sodium carboxymethyl cellulose and moisture, preferably in spray dried, free flowing bead form.

9 Claims, No Drawings

BIODEGRADABLE, NON-POLLUTING, HEAVY DUTY SYNTHETIC ORGANIC DETERGENT COMPOSITION

This invention relates to synthetic organic detergent compositions. More particularly, it relates to such compositions based principally on higher paraffin sulfonate synthetic organic detergent, soap, nonionic synthetic organic detergent, anti-redeposition agent, sodium carbonate and sodium silicate. Ranges and preferred ranges of proportions of such materials have been established for best utilities with the result that the compositions made exhibit excellent laundering ability in hard and soft waters, may be employed for low temperature as well as high temperature washing without causing yellowing of white articles of laundry washed, are useful for washing cottons, synthetics and mixtures thereof and leave the laundry washed feeling softer than is the case with competitive heavy duty laundry detergents based on mixtures of nonionic (or nonionic and anionic) detergents, sodium carbonate and sodium silicate.

Since the holdings made by the various public bodies that phosphates may contribute to eutrophication of our lakes and comparatively still waters detergent manufacturers have been attempting to produce excellent detergent compositions in which phosphates have been replaced by other builders. Thus, nitrilotriacetates, carbonates, citrates, silicates, phosphonates, polyelectrolytes and various other substitute builders have been studied but in most cases they have been found wanting. The phosphates have excellent soil dispersing and water softening properties, in addition to improving the detergency of synthetic organic detergents for which they serve as builders. Although some tests have indicated that the nitrilotriacetates produce equivalent results, such compounds are still being studied and their effects observed after initial findings that they could be harmful to the health of humans using them. In some compositions silicates wash as effectively as phosphates and in others carbonates perform acceptably, if one ignores the yellowing of clothing which occurs after use of carbonate-containing detergents and if the boardy feel of texiles, such as cottons, washed with carbonate detergents is not found to be objectionable. Also, some phosphate-substitute compositions are good for washing in softer waters but don't perform as acceptably in hard waters, apparently because they lack the softening properties of the phosphates.

In accordance with the present invention a detergent composition has been discovered which washes very well, better than the most popular of competitive commercial non-phosphate formulas, even in hard water, does not yellow cottons or other textiles washed with it and actually leaves the laundry softer than other carbonate-containing products. This composition comprises from 5 to 25% of a higher alkane sulfonate synthetic organic detergent, 1 to 5% of a poly-lower alkoxylated nonionic detergent, 1 to 5% of a higher fatty acid soap, 5 to 20% of sodium silicate of an $Na_2O:SiO_2$ ratio in the range of 1:1.6 to 1:2.8, 40 to 75% of a carbonate selected from the group consisting of alkali metal carbonates and bicarbonates with the major proportion thereof being alkali metal carbonate, 0.5 to 4% of an anti-redeposition agent, and 1 to 20% of moisture.

The alkane sulfonates employed are preferably paraffin sulfonates such as those made by the Hoechst process wherein sulfur dioxide is utilized in the sulfoxidation of paraffin in the presence of an initiator, such as ozone, ultraviolet radiation or per-acids. Such a method is so well known that it will not be otherwise described here except with respect to the starting materials employed and the carbon atom contents of the product. Higher paraffin sulfonates of 10 to 20 or 12 to 18 carbon atoms, are sulfonated, neutralized, and heated or solvent extracted to make a product which may be substantially pure (free of inorganic salts) or may contain sodium sulfate from co-neutralization of the sulfonic acid and sulfuric acid byproduct. If sodium sulfate is present, it will usually be in a proportion less than 50% of the total solids content of the paraffin sulfonate material charged and in the present formula the proportion of sodium carbonate (or sodium bicarbonate) will be diminished accordingly. However, it is preferred to utilize fairly pure paraffin monosulfonate such as sodium paraffin monosulfonate containing less than 5% of sodium sulfate neutralization byproduct, less than 2% of the corresponding unreacted paraffinic starting material, a negligible proportion or only a trace of sulfur dioxide at the most and no more than 20% and preferably less than 10% of paraffin disulfonates and other more highly sulfonated paraffins. Although the alkali metal paraffin monosulfonates are preferred anionic detergents of this invention equivalent alkane sulfonates, such as those manufactured by the reaction of sodium bisulfite and l-olefins of similar carbon atom contents may also be used. Furthermore, supplementing the paraffin sulfonate or in place of a minor part thereof (less than 50% of such content) there may be employed other anionic synthetic organic detergents, such as the sulfated or sulfonated lipophilic materials well known in the art to have detergent properties, including the linear high alkyl benzene sulfonates, the higher fatty alcohol sulfates, the higher fatty acid monoglyceride sulfates, higher fatty alcohol polyethoxy sulfates, the di-middle alkyl sulfosuccinates, the middle alkyl phenyl polyethoxy sulfates and sulfonates and various other sulfated nonionic detergents which are converted to anionics by sulfation. In these compounds the salt-forming ion is preferably an alkali metal, such as sodium or potassium and most preferably is sodium but other salt-forming mtals or non-metal radicals can be utilized, including ammonium, magnesium, alkanolammonium, e.g., triethanolammonium, etc. The higher fatty alkyl or acyl groups will normally be of 12 to 18 carbon atoms and the middle alkyls or acyls will be of 7 to 9 carbon atoms. Lower alkyls and alkoxies are of 2 to 4 carbon atoms, preferably of two carbon atoms and the number of alkoxies per molecule will usually range from 3 to 100, preferably from 10 to 30. Examples of such compounds include sodium higher fatty acids monoglyceride sulfate; sodium lauryl alcohol sulfate; triethanolamine lauryl sulfate; sodium linear dodecyl benzene sulfonate; potassium linear n-hexadecyl benzene sulfonate; sodium lauroyl N-methyl taurate; potassium stearyl alcohol polyethoxy sulfates of ten ethoxy groups per mole; nonyl phenol polyethoxy sulfates of 30 ethoxy groups per mole; ammonium dioctylsulfosuccinate; and the corresponding sulfonated nonionic compounds.

With the alkane sulfonate anionic detergent there will be present a nonionic detergent and soap to combine with it in the present builder system for best detergency and non-yellowing cleaning. The nonionic detergents may include at least some of any of the well known nonionics, including the Pluronics, Igepals, Ucons and the various nonionic detergent products, such as those of the Atlas Chemical Company known as Tweens, Spans, Brij's and Myrj's. These include pluronics F-68 and L-44; Igepals CO-630 and CA-630; Ucon 50HB-660; Tween 20 and Span 20. However, of this group it is preferred to employ the polyethoxylated higher fatty alcohols having three to 20 ethoxy groups per mole and wherein the higher fatty group is of 12 to 18 carbon atoms. More preferred are those of this class averaging about 14 to 15 carbon atoms per fatty alcohol and about 11 moles of ethylene oxide per mole, with the 14 and 15 mixed carbon atoms alcohol-11 moles ethylene oxide materials being considered best.

The soaps employed may be tallow-coco soaps or their equivalents and when tallow and coconut oil fatty acids or the corresponding fat and oil are employed the ratio thereof will usually be in the range of 70:30 to 90:10 as tallow-coco. It is preferred that this ratio be in the range of 75:25 to 85:15 and most preferred is the 4:1 ratio. Such soaps are a mixture of those of higher fatty acids of 12 to 18 carbon atoms, essentially.

Additional descriptions of useful anionic and nonionic detergents may be found in the test *Surface Active Agents* and *Detergents* by Schwartz, Perry and Berch (1958, Interscience Publishers) at pages 25–138 and in McCutcheon's *Detergents and Emulsifiers Annual* (for 1969 and 1970).

The main alkalizer and builder in the present compositions is sodium carbonate, preferably utilized in anhydrous form, although hydrates may also be employed under suitable conditions. It is normally preferred that the entire carbonate content be present as alkali metal carbonate and most preferably as sodium carbonate, anhydrous, but a minor proportion, no more than 50% of the total weight of the carbonate present may be of a bicarbonate such as alkali metal bicarbonate, e.g., sodium bicarbonate. With the alkane sulfonate-soap-nonionic detergent mixture and the carbonate builder salt it is important to have present a silicate, such as alkali metal silicate, e.g., sodium silicate. Such material will have an $Na_2O:SiO_2$ ratio of 1:1.6 to 1:2.8 and preferably this will be in the 1:2.0 to 1:2.6 range, with best results being obtained from the water soluble silicates, such as a sodium silicate of $Na_2O:SiO_2$ ratio of 1:2.4.

Also of importance to give the present products their superiority over competitive commercial materials also based on sodium carbonate-built detergents is the presence therein of an anti-redeposition agent. Such materials are well known and include sodium carboxymethyl cellulose, the preferred material, polyvinyl alcohol, polyvinyl pyrrolidone, hydroxypropyl methyl cellulose, hydroxyethyl cellulose, polyacrylamides, polyacrylates, polyelectrolytes broadly, starch and gelatin derivatives, etc. Although any of such materials can be beneficial to the present formula the sodium carboxymethyl cellulose is especially good with the other mentioned components of the compositions. To further improve the apperarance of the washed materials it is desirable to have present a fluorescent brightener, optical dye or similar material which functions to convert impinging invisible radiation into visible light. Thus, usual brighteners known for this purpose may be employed, including cotton brighteners, frequently referred to as CC/DAS brighteners, which are usually derived from the reaction product of cyanuric chloride and the disodium salt of diaminostilbene disulfonic; bleach stable brighteners, usually benzidine sulfone disulfonic acids, nathphotriazolyl stilbene sulfonic acid or benzimidazolyl derivative; polyamide brighteners, generally either aminocoumarins or diphenyl pyrazoline derivatives; and polyester brighteners, also useful on polyamides, which may be nathphotriazolyl stilbenes. Such materials are generally employed in mixture so that the product is useful on a wide variety of cottons, synthetics and mixtures thereof. Among the brighteners that are used in the present systems are: Calcofluor White ALF (American Cyanamid); ALF-N (American Cyanamid); SOF A-2001 (CIBA); CWD (Hilton-Davis); Phorwite RKH (Verona); CSL, powder, acid (American Cyanamid); CSL, liquid, monoethanolamine salt (American Cyanamid); FB 766 (Verona); Blancophor PD (GAF); UNPA (Geigy); Tinopal RBS (Geigy); and RBS 200 (Geigy). A further listing of such brighteners may be found in an article entitled *Optical Brighteners and Their Evaluation* by Per S. Stensby, a reprint of articles published in *Soap and Chemical Specialties* in April, May, July, August and September, 1967, espcially at pages 3–5 thereof.

In addition to the above mterials water may be present in the detergent composition. Also, small proportions of various other builders such as borax, boric acid, gluconic acid, citric acid, phosphonates and polyelectrolytes may be employed along with the carbonate and silicate builders but care should be taken to keep the quantities of such materials low, normally less than 5% each and with the total less than 10%, so as to avoid interfering with the very desirable activity of the present composition. Fillers, such as sodium or other alkali metal sulfates, bisulfates and chlorides may be present but normally the quantities of such compounds will be limited to no more than 15% of the total product. If the filler is sodium sulfate the upper limit may be 25%. The pH of the detergent is 1% solution at 25°C. will preferably be in the range of 9 to 12 and most often is about 9.5 to 10.5 before contact with the soiled clothing (generally acid products in clothing may lower the pH of the wash after about one pH unit).

In addition to the various materials described, normal adjuvants for heavy duty detergents may be utilized. These include buffers, fabric softeners, stabilizers, antioxidants, bleaches, perfumes, dyes, dispersible pigments, solvents, hydrotropes, sequestrants, emollients, surface active agents, emulsifiers, indicators, antifoams, foaming agents, foam stabilizers, etc. Normally the total adjuvant content will not be more than 5% of the product and generally it is desirable to limit each adjuvant to no more than 1% thereof.

The proportion of higher alkane sulfonate detergent in the present compositions is from 5 to 25%, preferably about 7 to 15% and most preferably about 10%, usually accompanied by about 10% of the corresponding mixed sodium paraffin disulfonate (1% of the product for the preferred concentration of mixed sodium paraffin monosulfonates of 14 to 18 carbon atoms). Poly-lower alkoxylated nonionic detergent constitutes from 1 to 5% of the compositions, preferably about 1 to 4% thereof and most preferably about 2%. If the products are spray dried it may be desirable to post-add some of the nonionic compound, keeping to a limit of about 2% or in some cases up to about 4%, on the final product basis, in the crutcher. The proportion of soap is from 1 to 5%, preferably 1 to 4% and most preferably about 2%, as sodium soap of a mixture of 80% tallow and 20% coconut oil fatty acids. The silicate, which may be obtained as G-D silicate from Philadelphia Quartz Company, or which may be a polysilicate such as that which can be obtained from J. Huber & Co., is present in an amount of from 5 to 20%, preferably 5 to 12% and most preferably about 9% of the final product. The carbonate, most preferably sodium carbonte, anhydrous, constitutes 40 to 75% of the product, preferably 55 to 75% thereof and most preferably about 66%. Moisture content is often determined by the desired degree of flowability of the product and its physical form, e.g., spray dried spherules, powders or granules, but normally sufficiently flowable compositions are capable of being manufactured in the 1 to 20% moisture range. Moisture content will preferably be from 5 to 12% and most preferably about 7.1% of the product. Desired produts with such contents of moisture will flow sufficiently freely and will not have any tendencies toward excessive dusting. The anti-redeposition agent will be present in such proportion as to perform its stated function, 0.5 to 4% being sufficient, with a preferable range being from 1 to 3% and most preferable action being observed when about 1.5% of sodium carboxymethyl cellulose is used. The proportion of fluorescent brightener will usually be from 0.2 to 3%, preferably 0.5 to 2% and in the present compositions about 1.0% is found to be most satisfactory.

The invented compositions may be maufactured by various suitable techniques, including dry blending, spray drying, roll drying, vacuum drying, and with post-spraying of proportions of some materials. When drying operations are employed a crutcher mix or other solution-suspension will normaly be prepared first so as to distribute the various constituents homogeneously throughout. A preferred method of manufacture is by spray drying in which a slurry having a solids content of from 50–85% is made up of the various constituents, sprayed through spray nozzles into a heated gas stream and removed in dried spherule form. Because of their form such materials are free flowing and more readily soluble in wash water and exhibit less of a tendency to cake than mere powders. It is most desired that the sizes of the particles obtained be in the 6 to 180 mesh range, preferably from 8 to 140 mesh and most preferably from 8 to 100 mesh. Such particles may be produced by regulating the spray nozzle sizes, spraying pressures, air entrainment, tower temperatures and modifying other conditions in a manner known to the spray drying art. If outside the range, they may be screened and small particles may be recycled into the crutcher mix so as to produce the final product particles all in the mentioned range, with a minimum of fines. Similarly, these particle size ranges are preferred for granulated, dry mixed and other such products and grinding techniques and screening operations will be adjusted accordingly to produce particulate materials having such sizes.

No special conditions are required for use of the present detergents and they are employed in the same manner as commercial products now on the market. They may be utilized in cold or hot water washing, with hard or soft waters. They are useful in both top loding (agitator) and side loading (tumbling drum) washing machines because they produce a controlled foam. The concentration of detergent used in the wash water will usually be in the range of 0.05 to 0.5%, preferably 0.1 to 0.3% and most preferably about 0.15%. At such concentrations the detergent compositions satisfactorily wash cottons, synthetics and mixtures thereof in both soft and hard water and are superior in producing a wash that is clean and has less of a yellow tinge to it than that washed with the best non-phosphate detergent which is nationally available. Because soluble carbonate compositions sometimes tend to precipitate as calcium carbonate in hard water and deposit on the material washed, giving it a tendency to yellowness and making it stiffer than desirable, the fact that the present compositions wash white and make the laundry softer in hard waters is an important unexpected advantage, apparently at least in part attributable to the particular anionic detergents employed, the paraffin sulfonates. For example, in water of a hardness of 100 p.p.m. good non-yellowing wash will be obtained with the present products in both hot and cold water (5° to 95°C.) applications and the washed laundry will be less harsh or boardy to the feel than control products of different formulation and without the presence of paraffin sulfonate. Such results are otained with respect to a variety of types of soils, including clays, skin soils (natural sebum and skin particles), and standard experimental soils, based on carbon black and mineral oil.

The following examples illustrate but do not limit the invention. Unless otherwise mentioned, all parts are by weight and all temperatures are in °C.

EXAMPLE 1

| | Parts by weight |
|---|---|
| * Sodium paraffin monosulfonate (Hoechst) | 10.0 |
| ** Neodol 45–11 ethoxylated alcohol (Shell) | 2.0 |
| Sodium soap chip (80:20 sodium tallow:coco soap, containing 10% moisture) | 2.0 |
| Sodium silicate, G-D, (Philadelphia Quartz Co.) | 8.6 |
| Sodium carboxymethyl cellulose, 10-D, 65% active ingredient (DuPont) | 1.5 |
| Sodium carbonate, anhydrous (Baker Chemical Co.) | 66.0 |
| Fluorescent brightener mixture (Tinopal RBS-200 (Geigy); Calcofluor White ALF (American Cyanamid); and SOF A-2001 (CIBA) | 0.9 |
| Moisture | 7.0 |
| Perfume, other minor adjuvants | 2.0 |

* Mixed $C_{14}$–$C_{17}$ paraffins, accompanied by (but not including) about 10% disulfonate.

** Fatty alcohol of a mixture of 14 and 15 carbon atoms and eleven ethoxy groups per mole.

The above formula is made by spray drying a crutcher mix of the constituents and spraying onto the surfaces of the particles, which are in the 6 to 140 mesh range, U.S. Standard Sieve Series, 0.2% of perfume. Alternatively, the mix is produced in dry mixing equipment and is sieve to the mentioned desired particle size range. When employed in top loading or side loading washing machines in the normal manner at a temperature in the range of 5° to 95°C. at 0.2% concentration and for washing periods of 10 to 45 minutes laundry items washed with it, including cottons, synthetics, e.g., nylons, Dacron, permanent pressed fabrics and synthetic-cotton mixtures, are washed white with very little or any yellow tinge and feel softer than when washed under similar circumstances with competitive commercial non-phosphate detergent compositions.

In laboratory tests to determine the extent of improvement over competitive products testing is effected with the mixed detergent composition against five types of fabrics, soiled with three types of soil, with washing at two diffeent temperatures 21° and 49°C. The fabrics washed are cotton, nylon, Dacron, Dacron-cotton blends and wash-and-wear treated textiles. After conventional washing cycles of 5 minutes to 45 minutes for such materials, the washed textiles, initially white before soiling, are measured for reflectances, utilizing a Gardner colorgard reflectometer. R*d* values and *b* values are obtained, the former indicating better reflectance or brightness at higher values and the latter indicating more yellowing at higher values. The following tables show the comparative reflectances and yellownesses of comparably soiled materials after washings with the composition of this example, compared to a commercial (Sears) laundry detergent. Soils employed are Bandy black clay, utilized to test clay removal, a significant detergency problem; test fabric solid cloth, soiled with a mixture of carbon black and mineral oil; and skin soil (three cycles of washing are utilized).

Results of the comparative testings are given in the following tables.

TABLE I (Test water hardness is 100 p.p.m., temperature is 21°C. and the detergent composition concentration is 0.15%)

| | Bandy Black Clay | | | | | | | |
|---|---|---|---|---|---|---|---|---|
| | Present Formula | | | | Commercial Laundry Detergent | | | |
| | Soiled Area | | Clean Area | | Soiled Area | | Clean Area | |
| Fabric | Rd | b | Rd | b | Rd | b | Rd | b |
| Nylon | 82.5 | 3.3 | 84.9 | 2.2 | 82.2 | 4.5 | 84.7 | 3.5 |
| Spun Dacron | 78.2 | 6.8 | 85.7 | −3.5 | 73.1 | 4.7 | 86.0 | −2.0 |
| Dacron-cotton | 76.1 | 3.7 | 87.9 | −2.8 | 76.0 | 7.3 | 85.8 | 3.4 |
| Cotton | 83.2 | −1.2 | 89.0 | −4.9 | 81.9 | 1.7 | 88.7 | −2.2 |
| Test Fabric Soiled Cloth | | | | | | | | |
| Dacron-cotton | 39.2 | −1.1 | 85.0 | −1.5 | 39.1 | −1.0 | 84.1 | −1.5 |
| Spun Dacron | 28.1 | 0.9 | 83.0 | 3.5 | 29.0 | 1.1 | 83.0 | 3.5 |
| Spun Nylon | 73.7 | 1.3 | 85.8 | 1.1 | 72.2 | 2.5 | 85.7 | 2.4 |
| Cotton | 32.7 | −2.4 | 88.4 | −4.6 | 32.7 | −1.0 | 87.5 | −2.8 |
| Wash & Wear | 44.2 | 0.1 | 87.1 | −0.1 | 44.2 | 0.8 | 85.7 | 1.1 |
| 3 Cycle Skin Soil Test | | | | | | | | |
| Nylon | 84.5 | 0.1 | 85.0 | 0.2 | 84.4 | 1.9 | 84.7 | 2.2 |
| Spun Dacron | 84.4 | 3.2 | 85.4 | 3.3 | 84.2 | 3.2 | 85.4 | 3.3 |
| Dacron cotton | 86.1 | −2.8 | 87.3 | −3.0 | 86.0 | −2.9 | 86.9 | −3.0 |
| Cotton | 88.4 | −5.4 | 89.3 | −5.7 | 88.4 | −5.0 | 88.9 | −4.8 |

TABLE II (Test water hardness is 100 p.p.m., temperature is 49°C. and the detergent composition concentration is 0.15%)

| | Bandy Black Clay | | | | | | | |
|---|---|---|---|---|---|---|---|---|
| | Present Formula | | | | Commercial Laundry Detergent | | | |
| | Soiled Area | | Clean Area | | Soiled Area | | Clean Area | |
| Fabric | Rd | b | Rd | b | Rd | b | Rd | b |
| Nylon | 82.9 | 0.4 | 84.7 | −1.2 | 82.7 | 3.7 | 84.1 | 2.7 |
| Spun Dacron | 75.7 | 7.6 | 85.6 | 3.4 | 76.1 | 6.0 | 85.8 | 3.5 |
| Dacron-cotton | 78.0 | 2.6 | 87.0 | −2.4 | 78.0 | 2.4 | 86.9 | −2.4 |
| Cotton | 82.0 | −0.8 | 89.0 | −5.4 | 82.2 | 0.3 | 88.5 | −3.5 |
| Test Fabric Soiled Cloth | | | | | | | | |
| Dacron-cotton | 34.5 | −1.1 | 84.1 | −1.5 | 35.0 | −1.2 | 84.3 | −1.8 |
| Spun Dacron | 26.9 | 1.0 | 80.4 | 3.2 | 27.1 | 1.0 | 82.3 | 3.5 |

TABLE II-continued (Test water hardness is 100 p.p.m., temperature is 49°C. and the detergent composition concentration is 0.15%)

| | Bandy Black Clay | | | | | | | |
|---|---|---|---|---|---|---|---|---|
| | Present Formula | | | | Commercial Laundry Detergent | | | |
| | Soiled Area | | Clean Area | | Soiled Area | | Clean Area | |
| Fabric | Rd | b | Rd | b | Rd | b | Rd | b |
| Spun Nylon | 73.9 | −1.7 | 85.7 | −2.0 | 74.2 | 1.0 | 85.7 | 0.7 |
| Cotton | 34.6 | −3.2 | 87.8 | −5.1 | 35.1 | −2.3 | 87.3 | −4.2 |
| Wash & Wear | 48.1 | 0.1 | 86.0 | 0.1 | 47.5 | 0.9 | 86.3 | 1.0 |
| 3 Cycle Skin Soil Test | | | | | | | | |
| Nylon | 84.2 | −3.4 | 85.0 | −3.6 | 84.2 | 1.6 | 84.7 | 1.8 |
| Spun Dacron | 81.6 | 2.9 | 85.2 | 3.2 | 81.8 | 2.6 | 85.4 | 3.1 |
| Dacron-cotton | 85.3 | −2.6 | 87.4 | −2.9 | 85.4 | −3.1 | 87.4 | −3.1 |
| Cotton | 88.1 | −4.6 | 89.2 | −5.2 | 88.2 | −5.2 | 88.8 | −5.4 |

From the above data it is apparent that the present composition cleans as well as or better than the comparative formula and that it produces a whiter, less yellow, washed material. The test specimens also feel softer to the touch, especially those of cotton. This distinction is even more apparent after washing in a water of higher hardness, e.g., 300 p.p.m., as $CaCO_3$.

EXAMPLE 2

The composition of Example 1 is modified by increasing the paraffin monosulfonate concetration to 15%, increasing the Neodol 45-11 concentration to 3%, increasing the sodium silicate content to 10%, diminishing the sodium carboxymethyl cellulose concentration to 1% and diminishing the sodium carbonate concentration to 59.1%.

The product made, when tested in the manner described in Example 1, is found to be of satisfactory detergency and does not yellow white articles washed with it. It also leaves the laundry washed feeling softer than comparable commercial carbonate-based synthetic organic detergent compositions.

EXAMPLE 3

The composition of Example 1 is modified by replacement of the sodium paraffin monosulfonate with one made from paraffins of 16 and 18 carbon atoms, about equal quantities of both being employed, and with about twice as much of the corresponding disulfonate (20%) being present. Other changes in the formulation include replacement of Neodol 45-11 with Neodol 25-7 and of the soap chip with one made from stearic acid, in which soap 20% of the metal is potassium and 80% is sodium. The sodium silicate is partialy replaced (50%) with a silicate of an $Na_2O:SiO_2$ ratio of 1:2.0 and the sodium carbonate has 40% of the content thereof (26.4% parts) replaced with sodium bicarbonate. The moisture content is reduced to 6 parts. Such a product is made by blending of dry powdered components and in the case of liquid materials by blending them in with the other constituents. Following formulation the mix is screened to be within the 8 to 140 mesh range and is then tested in practical wash tests. It is found to be a satisfactory detergent comparable to phosphate-containing detergents in washing powder and, like the phosphate detergents it does not yellow white textiles or laundry items washed with it. It feels softer to the hand after drying than does a comparable carbonate-containing detergent composition. When the sodium carboxymethyl cellulose is replaced by a mixtue of polyvinyl alcohol and hydroxyethyl cellulose detergency is diminished slightly but otherwise the same properties are retained. The dimension in detergency may be made up by increasing the anti-redeposition agent content to three parts by weight of the formulation. In other experiments 20% of the sodium paraffin monosulfonate content of the Example 1 formula is replaced by linear dodecyl benzene sulfonate and 20% of the Neodol 45-11 of Example 1 is replaced by a mixture of equal parts of Neodol 25-3 Igepal CO-630. Little change in the properties of the product (compared to that of Example 1) results whether laundry is washed in it in hard or soft water at high or low temperature.

The invention has been described with respect to illustrations and working examples thereof but is not to be considered as limited to them because it is evident that one of skill in the art with the present specification before him will be able to utilize substitutes and equivalents without departing from the spirit and scope of the invention.

What is claimed is:

1. A readily biodegradable non-polluting heavy duty phosphate free synthetic organic detergent composition characterized by excellent laundering ability in hard and soft waters for low temperature as well as high temperature washing, without causing yellowing and which leaves the laundry softened, which comprises from 5 to 25% of a higher $C_{10}$–$C_{20}$ alkane sulfonate synthetic oganic detergent, 1 to 5% of nonionic detergent, 1 to 5% of a higher $C_{12}$–$C_{18}$ fatty acid soap, 5 to 20% of sodium silicate of a $Na_2O:SiO_2$ ratio in the range of 1:1.6 to 1:.2.8, 40 to 75% of a carbonate selected from the group consisting of alkali metal carbonate and bicarbonates with the major proportion thereof being alkali metal carbonate, 0.5 to 4% of an anti-redeposition agent, and 1 to 20% of moisture.

2. A detergent composition according to claim 1 wherein the higher alkane sulfonate is a sodium paraffin monosulfonate of 12 to 18 carbon atoms, the nonionic detergent is a polyethoxylated higher $C_{12}$–$C_{18}$ fatty alcohol having 3 to 20 ethoxy groups per mole, the higher fatty acid soap is a sodium soap, the sodium silicate is of an $Na_2O:SiO_2$ ratio of 1:2.0 to 1:2.6, the carbonate(s) are sodium salts and the anti-redeposition agent is selected from the group consisting of sodium carboxymethyl cellulose, polyvinyl alcohol, polyvinyl pyrrolidone, hydroxypropyl methyl cellulose and hydroxyethyl cellulose.

3. A detergent composition according to claim 2 which comprises from 7 to 15% of mixed sodium paraffin monosulfonate of 14 to 18 carbon atoms, 1 to 4% of ethoxylated higher fatty alcohol wherein the higher fatty alcohol is of an average of 14 to 15 carbon atoms and the ethylene oxide content averages about 11 moles of ethylene oxide per mole of higher fatty alcohol, 1 to 4% of sodium soap of a mixtue of tallow and coconut oil fatty acids wherein the ratio of tallow to coconut oil acids is from 7:3 to 9:1, 5 to 12% of sodium silicate of an $Na_2O:SiO_2$ ratio of about 1:2.4, 1 to 3% of sodium carboxymethyl cellulose, 55 to 75% of sodium carbonate and 5 to 12% of moisture.

4. A detergent composition according to claim 3 which comprises about 10% of mixed sodium paraffin monosulfonates of 14 to 18 carbon atoms together with up to about 20% of the corresponding mixed sodium paraffin disulfonate, 2% of the ethoxylated higher fatty alcohol wherein the higher fatty alcohol is of about 14 to 15 carbon atoms and the ethylene oxide content thereof is about eleven moles of ethylene oxide per mole of higher fatty alcohol, 2% of sodium soap of a mixture of about 80% tallow and 20% coconut oil fatty acids, 9% of sodium silicate of an $Na_2O:SiO_2$ ratio of about 1:2, 1.5% of sodium carboxymethyl cellulose, 66% of sodium carbonate, 1% of fluorescent brighteners and 7.5% of moisture.

5. A detergent composition according to claim 1 containing as a replacement for up to less than about 50% of said alkane sulfonate or as supplemental to said alkane sulfonate anionic detergent selected from the group consisting of higher alkyl benzene sulfonates, higher fatty alcohol sulfates, higher fatty acid monoglyceride sulfates, higher fatty alcohol polyethoxy sulfates, di-middle alkyl sulfosuccinates, middle alkyl phenyl polyethoxy sulfates and sulfonates wherein the salt forming ion is alkali metal, ammonium, magnesium or alkanol-ammonium and wherein the higher fatty alkyl or acyl groups contain from 12 to 18 carbon atoms, the middle alkyl or acyl contains from 7 to 9 carbon atoms and the number of alkoxy groups per molecule ranges from 3 to 100.

6. A detergent composition according to claim 5 wherein said anionic detergent is selected from the group consisting of sodium higher fatty acids monoglyceride sulfate, sodium lauryl alcohol sulfate, triethanolamine lauryl sulfate, sodium linear dodecyl benzene sulfonate, potassium linear n-hexadecyl benzene sulfonate, sodium lauroyl N-methyl taurate, potassium stearyl alcohol polyethoxy sulfates of 10 ethoxy groups per mole, nonyl phenyl polyethoxy sulfates of 30 ethoxy groups per mole, ammonium dioctylsulfosuccinate, and the corresponding sulfonated nonionic compounds.

7. A detergent composition according to claim 1 wherein said carbonate is anhydrous.

8. A detergent composition according to claim 1 having a pH of from 9 to 12.

9. A method of washing which comprises contacting articles to be laundered with an aqueous medium containing from 0.05 to 0.5% of the composition of claim 1.

* * * * *